US006106398A

United States Patent [19]

Davis

[11] Patent Number: 6,106,398

[45] Date of Patent: Aug. 22, 2000

[54] CONTROL APPARATUS

[76] Inventor: Ivis Howard Davis, 2806 Stoneridge Dr., Garland, Tex. 75044

[21] Appl. No.: 09/030,811

[22] Filed: Feb. 26, 1998

[51] Int. Cl.[7] ..... A63F 9/22

[52] U.S. Cl. ..... 463/38; 273/148 B; 463/36; 463/37

[58] Field of Search ..... 463/38; 273/148 B; 345/161; 74/471 XY

[56] References Cited

U.S. PATENT DOCUMENTS

| | | | |
|---|---|---|---|
| 3,091,130 | 5/1963 | Payerle et al. | 74/471 XY |
| 3,707,093 | 12/1972 | Worden | 74/471 XY |
| 4,382,166 | 5/1983 | Kim | 200/6 |
| 4,491,325 | 1/1985 | Bersheim | 463/38 |
| 4,552,360 | 11/1985 | Bromley et al. | 463/38 |
| 5,128,671 | 7/1992 | Thomas, Jr. | 341/20 |
| 5,503,040 | 4/1996 | Wright | 74/471 |
| 5,510,810 | 4/1996 | Nishijima et al. | 345/156 |
| 5,551,701 | 9/1996 | Bouton et al. | 463/36 |
| 5,700,194 | 12/1997 | Hsien | 463/37 |
| 5,767,840 | 6/1998 | Selker | 345/161 |
| 5,896,125 | 4/1999 | Niedzwiecki | 345/168 |

*Primary Examiner*—Jessica J. Harrison
*Assistant Examiner*—Jackie Kasick

[57] ABSTRACT

Control apparatus is illustrated in the form of a joystick type device that can be manipulated or operated by a human hand in a plurality of directional modes with respect to a support base which support base may include a handgrip for the operators other hand to provide additional support when the joystick is being vigorously manipulated. The apparatus can provide signals responsive to horizontal, vertical, rotational and tilt movement with respect to the support base in addition to signals generated by the actuation of contacts on the joystick by individual digits of the hand moving the joystick. A further handgrip on the support base may include contiguous additional signal generators actuateable by digits of the hand contacting the further handgrip.

15 Claims, 3 Drawing Sheets

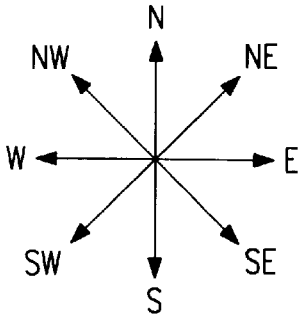
FIG. 3
FIG. 4
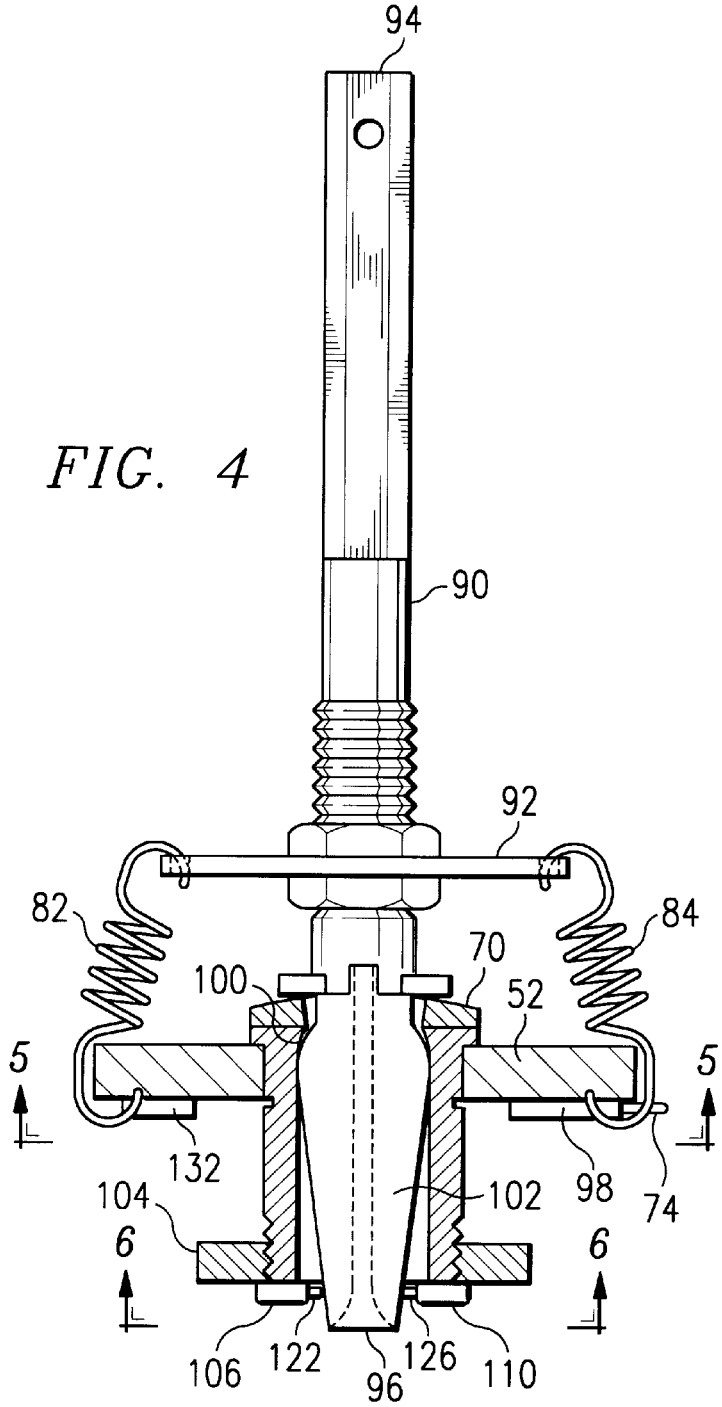

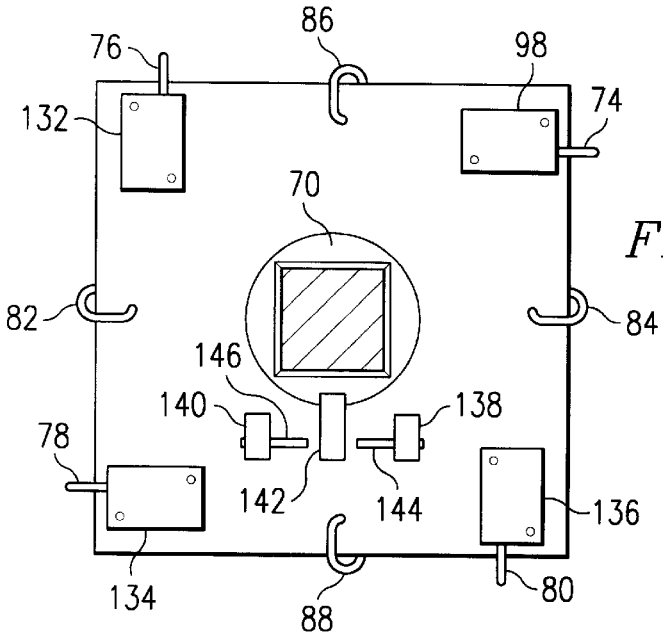
FIG. 5
FIG. 6
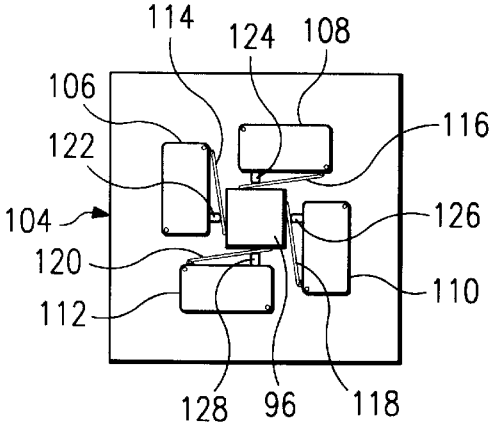
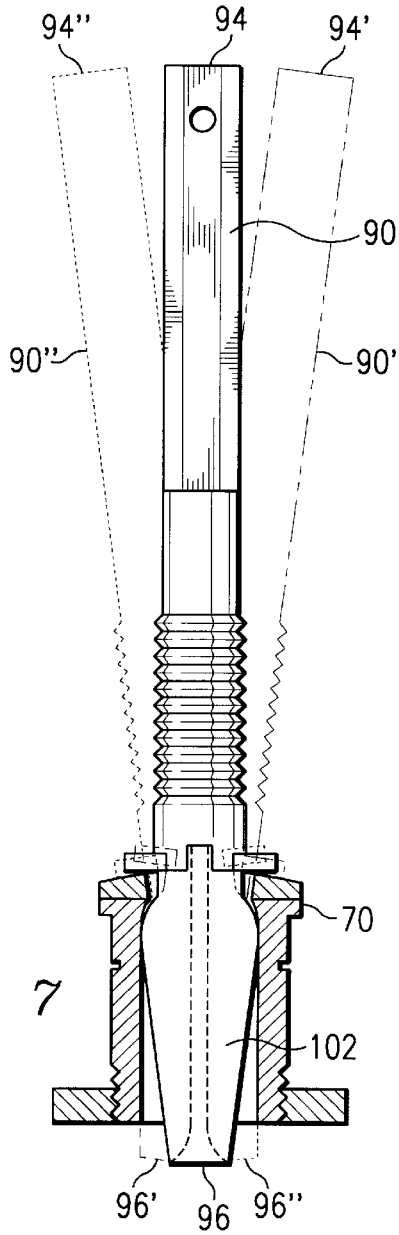
FIG. 7

CONTROL APPARATUS

FIELD OF INVENTION

This invention relates to control apparatus and more specifically to a device for remotely controlling other objects such as such as program actions or gaming objects in a computer, vehicles or robots. Even more specifically this invention pertains to a joystick type device that can be manipulated by a first human hand in a plurality of directional modes with respect to a support base. Optionally, a further handgrip incorporated in the support base may be used for helping to stabilize said support base and may include contiguous additional signal generating means actuateable by digits of a hand in contact with said further handgrip.

BACKGROUND OF THE INVENTION

Prior art joysticks have been conventionally used to provide positioning information in a variety of configurations. Normally however, these prior art units have been tiltable in at least 4 directions and have often had one or more control buttons for firing missiles etc. Some of these prior art units have had acceleration sensing means to determine how fast the stick has been moved for providing not only directional control to an object but also acceleration.

Some joysticks such as shown in U.S. Pat. No. 4,641,123 to James Whitehead and assigned to RCA are designed to sense vertical (Z axis) directional movement in addition to a tilt generated X and Y axis movement. This device even permits limited rotational movement detection.

To obtain more freedom of control others such as Hirabayashi in U.S. Pat. No. 5,329,276 have used relatively expensive angular velocity detectors in a hand held device. Since such a device has no reference base, switches must be used to tell the device when to start and stop generating output signals indicative of movement. Thus there is no solid initial position reference point available to either the person operating same or the computer mechanism receiving instructions therefrom to be used in further moving the controlled object.

Substantially all known gaming type joystick devices that have been interfaced to a personal computer using a special port typically designated as a game port. A special card is required on most computers to provide a game port and thus adds expense to the playing of games. Also some games require additional input signals beyond which can be obtained from a joystick. Typically these additional inputs can be obtained from a keyboard using the keyboard input or interface built into all personal computers. All known personal computer games using the above referenced joystick devices may be played using the keyboard as the source of all signals. However, the playing of the games using keyboard generated inputs suffers from slow human response time due to the unnaturalness of formulating the input actions.

If a control mechanism could not only provide tilt in the X and Y plane but additionally vertical, rotational and X and Y axis movement motions, the human reaction or response time would be substantially minimized due to the mentally perceived correlation between hand movements and the device or object being controlled. Further, when more inputs are required than can be provided with one hand, it would be desirable, in reducing human response time, to be able to control other inputs with the other hand such that another device, such as a separate keyboard, need not be consulted visually to produce said inputs. Finally, it would be desirable to eliminate the expense of additional cards to be installed and serviced in a computer to obtain the previously referenced game port interface.

It is an thus an object of the present invention to provide a control device that has a wider range of movement detected actions (sometimes described as degrees of freedom) than has been contained in the prior art.

A further object of this invention to use the standard keyboard interface when controlling a personal computer programs responses to input signals.

A still further object of this invention is to provide apparatus that can be used concurrently with a keyboard such that either one or both may provide signals to the computer via a single port perceived by a computer as a keyboard interface.

Other objects and advantages will be apparent from a reading of the appended specification and claims along with the drawings.

SUMMARY OF THE INVENTION

A joystick according to the present invention includes a handle for use by a first hand with respect to a base which base may conveniently incorporate a base stabilizing grip for the other hand whereby movements of the first hand can be made and detected for the purpose of providing unique signal outputs in the horizontal, vertical and rotational directions as well as allowing detected tilt movements in eight separately definable directions. The stabilizing handgrip for the operators other hand and a recessed armrest adjacent thereto may be used to provide additional support when the joystick is being vigorously manipulated. Control surfaces on the joystick itself may provide additional signal outputs due to actuation by or contact with specific digits on the first hand. Finally the stabilizing grip on the support base may include contiguous additional signal generating means actuateable by digits of the hand contacting said stabilizing grip.

BRIEF DESCRIPTION OF THE DRAWINGS

FIG. 3 is a diagram incorporating directional coordinates for use in explaining the operation of the inventive concept;

FIG. 4 is a cross section view of the joystick handle and its mounting mechanism through a central portion of FIG. 2;

FIG. 5 illustrates a view of a portion of the joystick mounting mechanism in the direction defined in FIG. 4 for sensing horizontal movement of the joystick;

FIG. 6 provides an illustrative view of the mechanism for sensing tilt of the joystick from a viewpoint defined in FIG. 4; and FIG. 7 illustrates the movement of the base end of the joystick handle when the joystick is tilted from vertical.

DETAILED DESCRIPTION

Figure 1:
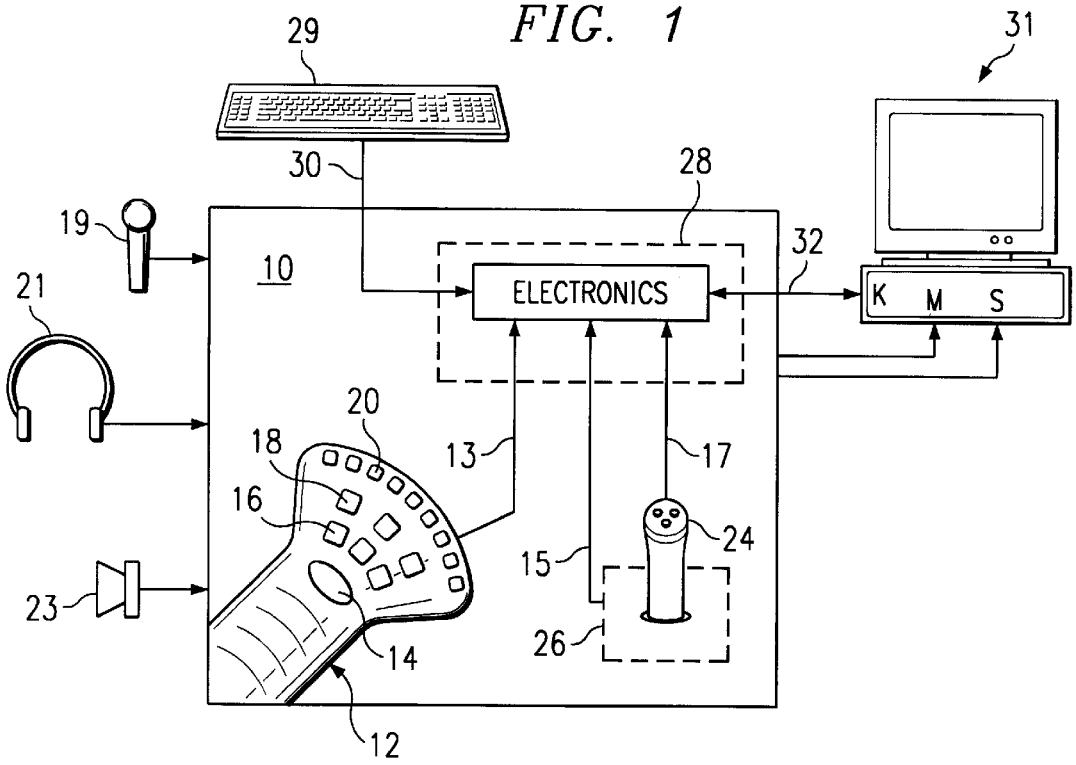
FIG. 1 is a combination pictorial view and high level block diagram of an overall game playing base apparatus incorporating a joystick constructed in accordance with the present inventive concepts, connected between a keyboard and a computer and further including additional actuateable contacts for use by the hand not involved with operating the joystick.

FIG. 1 illustrates a joystick apparatus base or support means generally indicated as 10 incorporating an arm rest recessed portion 12. Normally the recess 12 would be used in conjunction with a users left arm and hand and thus would be in a "left hand" portion of the base. Within recessed portion 12 there is a stabilizing grip or other handgrip 14 contiguous several sets of switched contacts 16, 18 and 20. In a preferred embodiment of the invention, contacts 20 were used to provide the same signal outputs as would be provided by function keys F1 through F12 of a computer keyboard. To simplify the drawing, less than 12 contacts are shown. The further sets of contacts 16 and 18 may provide other functions as desired. Examples of other functions might be the Esc key, the Enter key, etc. Another corner of the board shows a remote control means or joystick handle 24 centrally located with respect to a dash line box 26 representing the joystick movement sensing portion of the control apparatus. A further dash line box 28 may contain the electronics for manipulating or otherwise combining electrical signals received from the joystick sensors and from contact sets 16, 18 and 20 with any signals received from a keyboard on lead 30 before outputting same to a computer 31 on lead 32. It should be noted that the lead 32 may transmit signals in both directions. Not only can signals be sent to the computer 31 indicating the closure of any switch contact of keyboard 29 or of base 10, but additionally programming instructions can be sent from the computer 31 to the electronics module instructing the module to send specific signals upon the closure of a given contact. The specific signals may represent a series of contact closures representing a set of instructions similar to a programing macro instruction. Alternatively, the electronics module may be instructed to send a given signal other the its default output upon the closure of a contact. An example might be to send a signal representative of a "F1" function key when a "space" key is actuated. A line 13 represents a plurality of signal links between the left hand switch contacts and a set of inputs of an electronics module shown within box 28. One example of a suitable electronics module is a keyboard encoder part number VIP128 sold by Zetra Systems Corp. A line 15 represents a plurality of signal links supplying further input signals to the electronics module from the base of the joystick representing various tilt, horizontal and rotational movements of the joystick. A line 17 represents a plurality of signal links supplying further input signals to the electronics module from switch contacts on the extremity of the joystick which typically may be operated by the users thumb. While contact switches were used in one embodiment of the inventive concept to generate signals by the hand resting on handgrip 14, other signal generating means such as capacitive coupling, infrared signal interruption etc could also be used in the generation of additional signals. A microphone 19 is illustrated supplying signals through the base 10 to an M (microphone) input of computer 31. Headphones 21 and a box 23 representing one or more speakers are connected through base 10 to a S or speaker input of computer 31.

Figure 2:
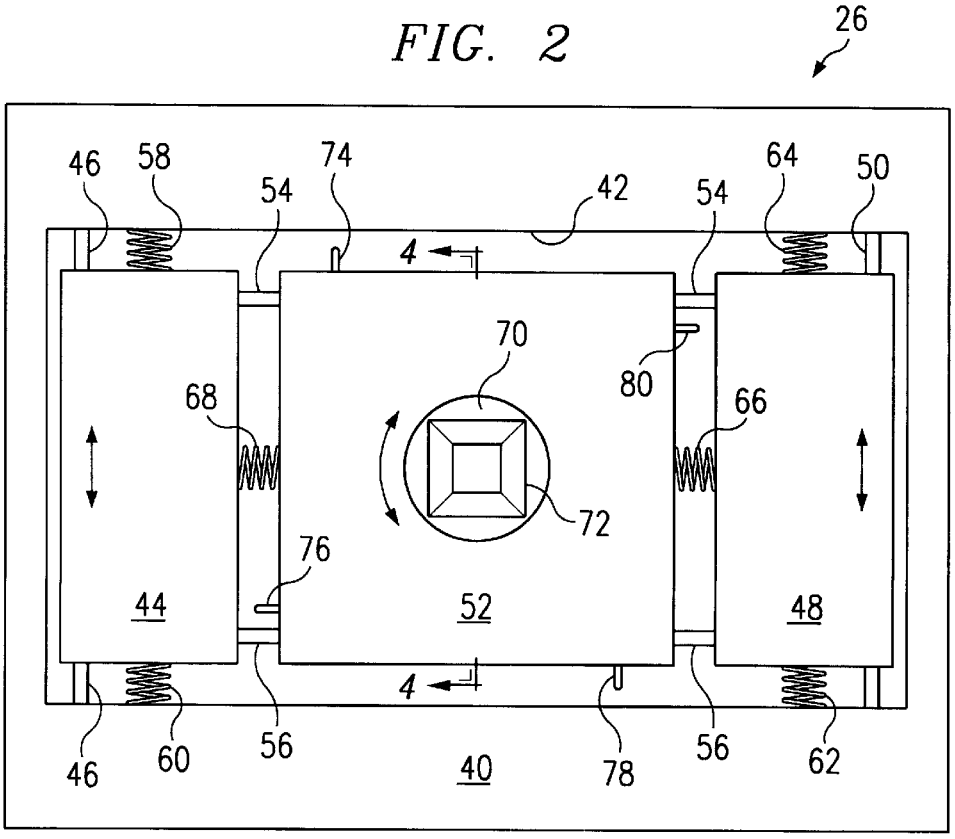
FIG. 2 is a top view of the a base portion of the joystick which moves sideways, forward and backward.

The dash line box 26 or support means of FIG. 1 is shown in more detail in FIG. 2 as having a rectangular block or support means 40 having an opening 42. A moveable member 44 is slidably mounted with respect to block 40 via a rod or bearing surface 46 extending from one side of opening 42 to the opposite side. This member is shown on the W (as indicated by the arrow indicator in FIG. 3) or left hand side of opening 42. As illustrated, member 44 may be moved in a N-S or back and forth direction. A similar moveable member 48 is slidably mounted with respect to block 40 via a rod or bearing surface 50 on the E or right hand side of opening 42. This member 48 also moves in a N-S direction. A joystick mounting member 52 is slidably mounted with respect to blocks 44 and 48 via rods 54 and 56 and can move on rods 54 and 56 left and right or E-W. Thus horizontal pressure on the joystick 24 in the E-W direction will move member 52 on bearing surfaces 54 and 56 while horizontal pressure on the joystick 24 in the N-S direction will move member 52 along with members 44 and 48 on bearing surfaces 46 and 50. A plurality of springs or neutral position inducing means 58 to 68 are shown in this figure for returning members 44, 48 and 52 to an "at rest" or neutral position. Near the center of member 52 there is shown a generally circular pivot member 70 which is designed to allow at least limited rotation of 70 with respect to member 52 as shown by the double ended arrows adjacent thereto. A generally square opening 72 is shown centrally located in the upper or illustrated surface of member 70 for use by a support member (not presently designated but illustrated in FIG. 7) of the joystick 24. A plurality of position sensitive switch extension means 74, 76, 78 and 80 are shown extending from the underside of member 52 and operate to activate switches not yet designated when member 52 is moved horizontally in the N, W, S and E directions respectively by forces applied to the joystick 24 relative the base 10 (or box 26 mounted therein). As will be observed, extension means 74 and 78 contact the sides of opening 42 when the joystick 24 is moved in a N or S direction respectively and extension means 76 and 80 contact members 44 and 48 when the joystick is moved in a W or E direction respectively.

In FIG. 4 there is presented a simplified cross sectional view of the member 52 with additional parts including a joystick support member 90 and springs or neutral position inducing means 82 and 84 connected between exterior edges of member 52 and a return to vertical member 92 located intermediate ends 94 and 96 of the member 90. A preferred embodiment of the invention used 2 additional springs or neutral position inducing means 86 and 88 not shown in FIG. 4. A switch 98 having extension means 74 is illustrated attached to the bottom of member 52. As may be observed in this cross sectional view supplementing the rotational information provided in connection with FIG. 2, the member 70 is generally cylindrical in shape. The support 90 was designed in one embodiment of the invention to have an upper portion that would fit through opening 72 in the pivotal member 70 as shown. The lower portion of support 90 was made larger at a pivot point before forming a frustum or truncated lower portion of a generally square pyramid shape 102 ending at end 96. When forces are applied to the top of the joystick 24 relative the base 10, it may tilt relative the pivot point 100 of support 90 since the shape of the lower portion 102 and the opening within member 70 allows this action. The tilting action may be more apparent from an observation of FIG. 7 to be amplified upon later. The springs 82-88 will act to return the support 90 to a vertical position when tilting forces are removed from the joystick 24. As will be apparent to those skilled in the art, the tilting of support 90 may occur in any direction and is not restricted to the N, E, S and W directions due to the circular opening in the lower portion of cylindrical pivot member 70 and the positioning of the return to vertical springs 82–88.

At the lower end of portion 102 of the support 90 and attached to cylindrical pivot member 70 is a tilt detection support member 104 having a plurality of tilt detection switches 106, 108, 110 and 112 mounted thereon as shown in FIG. 6 and two of which are shown in FIG. 4. These switches 106–112 each have a lever arm designated as 114 through 120 as shown in FIG. 6. The application of forces to these lever arms 106–112 by tilting the joystick 24 will cause the end of support 90 to move one or more of the lever arms and actuate one or two switches simultaneously through the movement of the appropriate designated switch extensions 122, 124,126 and 128. As will be noted the lever arms 114–120 are not shown in FIG. 4 but are clearly illustrated in FIG. 6. As will be further apparent, tilting the joystick 24 in a SE direction will operate two of the switches such as 108 and 106 since the bottom end 96 of support member 90 moves in the opposite direction that of the end 94 due to the pivoting action at pivot point 100.

The remaining switches on member 52 comprise 132-140 as more clearly illustrated in FIG. 5. The switches 132-136 incorporate the previously referenced switch extensions 76–80. Strictly speaking, the illustrations of FIGS. 5 and 6 are not exactly the views designated in FIG. 4 since FIG. 4 is actually a cutaway through the center of support 90. However, it is believed that it is appropriate and clear to those skilled in the art, that this simplification will properly display the views that would occur from the bottom of members 52 and 104 as defined in FIG. 4. An arm 142 extending from pivot member 70 acts to actuate one of switches 138 or 140 when rotational forces are applied to joystick 24 thus causing rotation of support 90 and accordingly of cylindrical pivot 70 within the opening of member 52. As before, the springs 82–88 will return the support 90 to a neutral position when rotational forces are removed from the joystick 24.

The explanations given above are believed sufficient to enable anyone to understand that tilting movement of the joystick in any of N, E, S and W directions will actuate at least one of switches 106–112 in FIG. 6 due to forces supplied by the sides of the pyramid frustum terminating in end 96 to one of the lever arms 114–120 and accordingly to one of the switch extensions 122–128. Forces applied to the joystick 24 to cause tilting in a direction intermediate the N, E, S and W directions may be sufficient to actuate two adjoining switches such as the previously mentioned switches 106 and 108.

FIG. 7 shows more detail as to the actual construction of one embodiment of support 90 and its' connection to and pivotal action with respect to pivotal member 70. The two dash line representations of support 90 and labeled 90' and 90" clearly illustrate the pivotal action and the resulting movement of the pyramid frustum adjacent end 96 which cause actuation of one or more of the tilt detection switches 106–112.

Vertical output signals are generated in one embodiment of this invention by using a biased return to center OFF toggle switch which may be actuated by thumb pressure at one side of the switch for UP signals and at the other side of the switch for DOWN signals. Another embodiment uses two separate normally open switches such as shown at the top of the joystick 24 in FIG. 1 to provide this function. Additional switch contacts may be mounted on the joystick housing 24 to provide additional signals to the computer 31. While the entire base member 40 could be mounted within base 10 on springs and further switches used to detect vertical forces applied to the joystick 24 with respect to the base 10, it is believed that such action would be ergonomically less desirable than the present means for generating the vertical signals to be transmitted to the computer from the joystick apparatus.

Operation

While the operation of the present concept is believed obvious from the detailed description provided supra, a few explanatory remarks will be provided in summarization of the detailed description and accompanying explanation already provided.

As explained previously, many electronically manipulated computer programs and in particular computer games require additional input signals beyond that provided by prior art joysticks. These additional input signals have traditionally been provided by actuating keys on a separate keyboard. However switching ones attention from a joystick control to a separate device such as a keyboard often interferes with a users concentration and may detrimentally affect the performance of the task at hand or the time in which it is completed. By adding further detectable modes of operation to a joystick over that traditionally provided, such as horizontal movement detection of the entire joystick in the N, S, E and W directions with respect to the joystick base, rotational movement detection of the joystick with respect to its base and tilt detection in the NE, NW, SE and SW directions, the correlation of hand movements to desired object movements on a computer monitor is more nearly obtained whereby the load or comprehension stress on the operators brain is reduced. It will be obvious, upon reflection, that when motions beyond tilt are applied to a joystick there must be some means to keep some part of the joystick apparatus stable with respect to some reference. Typically this is provided with the hand not operating the joystick motions. Since the operators hand is not idle anyway, it would be desirable to use some other part of the body such as the left arm to provide any required stabilization and use the fingers of the left hand to provide further signal inputs to the computer program as needed. Thus the left hand can provide inputs such as those provided by the function keys, the direction keys, the Esc, Enter and control keys etc.

Electronics, such as the previously mentioned keyboard encoder, within the block 28 is electrically connected to and collects the signals output by joystick 24 and its associated movement detection switches and the contacts or other signal generating devices adjacent handgrip 14 and inputs a representation thereof into a serial data stream to the computer via lead 32 using standard data collection, switch closure to serial data bit translation and transmission techniques. If inputs are detected as being received from the keyboard via lead 30 these signals are also multiplexed into the stream of data being supplied on lead 32 to the computer. In this manner a program may be directed to complete a specific function twice as fast as it normally would by simultaneously operating a key on the keyboard which provides the same signal as provided from one of the switches or contacts on the joystick apparatus on block 10 of FIG. 1. In this manner, this specific data signal would appear more often in a frame of information supplied to the computer than would occur if only one of the source signals were detected.

While I have described one embodiment of the inventive concept of providing joystick apparatus to be used in conjunction with a keyboard for supplying signals to a keyboard interface for operating a computer program in a more ergonomic and convenient manner than has been previously possible, I wish to be limited not to the specific embodiments shown and described but only by the appended claims.

What is claimed is:

1. Joystick apparatus for facilitating the use of a computer controlled object, comprising, in combination:

support structure having a horizontal orientation;

handle means generally oriented in a vertical direction from said support structure and including means for providing more than 12 directions of movement; and movement detection means for providing unique output signals identifying each of said more than 12 directions of movement of said handle means with respect to said support structure, said more than 12 directions of movement including at least two directions of tilt, at least two in rotation and at least two in the horizontal direction.

2. Joystick apparatus comprising, in combination:

support structure;

handle means movably attached to said support structure [means] whereby it is free to move in tilt, rotation and horizontal directions relative a restrained neutral position; and movement detection means for providing ON/OFF output signals uniquely identifying each direction of movement of said handle means with respect to said support structure the output signals persisting for the duration of deflection from said neutral position even when the handle is not moving.

3. Apparatus for interconnection between a computer keyboard and a keyboard I/O port of a computer comprising, in combination:

support structure;

joystick means movably attached to said support structure;

control means for concurrently passing both indications of keyboard key depression and detected movements of said joystick means with respect to said support structure to an attached computer, the detected movements of said joystick means being interpreted by the attached computer as keyboard key depressions.

4. Joystick apparatus comprising, in combination:

signal interconnection means for interconnecting said joystick apparatus between a computer keyboard and a keyboard I/O port of a computer; and joystick movement detection means for passing indications of keyboard key depressions and as well as concurrently passing indications of unique detected movements of said joystick to any attached computer as corresponding to predetermined keyboard key depressions.

5. Joystick apparatus for use with a computer wherein a unique joystick I/O port is not required comprising, in combination;

means for interconnecting said joystick apparatus between a typewriter style computer keyboard and a keyboard I/O port of a computer; and control means for concurrently passing signal indications of keyboard key depressions and signal indications of movements of said joystick to any attached computer.

6. Joystick apparatus for use with a computer wherein the requirement of a unique joystick I/O port is eliminated comprising, in combination;

joystick apparatus; and signal control means, comprising a part of said joystick apparatus, for serially interconnecting said joystick apparatus between a computer keyboard and a keyboard I/O port of a computer, said signal control means allowing passage of indications of keyboard key depressions while concurrently passing indications of movements of said joystick to any attached computer.

7. Joystick controller apparatus, comprising a housing;

a joystick supported by said housing for a. horizontal movement with respect to said housing in the X and Y directions, b. pivotal movement with respect to said housing to at least 2 tilt angles, c. rotational movement with respect to said housing and d. means incorporated in said joystick for providing vertical movement signal indications; and movement detection means incorporated in said housing for detecting said horizontal, pivotal, and rotational movements and outputting signals representative of same.

8. Control apparatus comprising, in combination:

signal interconnection means for interconnecting said control apparatus to a keyboard I/O port of a computer;

a base including a first handle moveable horizontally as well as tilt-ably with respect to said base and further including a second handle, fixedly incorporated in said base means, for stabilizing said base [means] while the first handle is being manipulated, adjacent a plurality actuateable signal generators;

detection means for passing indications of any activation of said actuateable signal generators and as well as passing indications of unique detected movements of said first handle to any attached computer as corresponding to predefined keyboard key depressions.

9. Apparatus as claimed in claim 8 comprising, in addition:

keyboard signal input means for connection to a keyboard whereby keyboard depression indicative signals may be received therefrom and transmitted to the keyboard I/O port concurrently with signals generated from detected movement of said first handle.

10. The method of providing multiple source keyboard type key actuation signal indications to the keyboard input port of a computer comprising the steps of:

serially inserting a signal manipulator between a keyboard and the keyboard I/O port of a computer; and providing hand motion signals from a source other than said keyboard to said signal manipulator representative of predetermined keyboard key actuations whereby said signal manipulator may concurrently provide multiple signals to said computer representative of the same keyboard key actuation from different signal sources.

11. The method of claim 10 wherein the hand motion signals are generated by a joystick type device.

12. Ergonomic control apparatus comprising, in combination:

support structure;

first hand grip means for movement in a plurality of directions, including both tilt and horizontal movement, with respect to said support structure;

second hand grip means comprising a part of said support structure and including a plurality of control means for actuation by digits of a human hand; and detection means for detecting movement of said first hand grip means and generating signal outputs representative of unique movements of said first hand grip means.

13. Apparatus as claimed in claim 12 wherein:

the detected unique movements of said first hand grip include horizontal movement forward, backward, left and right with respect to a neutral position on said support structure, tilt forward, backward, left and right with respect to said neutral position on said support structure, and rotation left and right with respect to said neutral position on said support structure.

14. Apparatus of the class described comprising:

computer including keyboard, display means and a keyboard I/O port;

control means connected in series with said keyboard and the combination being connected said keyboard I/O port;

support structure;

a joystick movably attached to said support structure, said joystick being restrained to normally return to a neutral position when no forces are applied thereto;

means, comprising part of said control means, for concurrently passing both indications of keyboard key depression and detected movements of said joystick with respect to said support structure to said computer, the detected movements of said joystick being interpreted by the computer as keyboard key depressions;

means for detecting the a first signal representative of actuation of a given key on the keyboard simultaneous with movement of said joystick in a direction to cause a corresponding second signal representative of the actuation of said given key whereby different than would occur when only said first or said second signal is detected.

15. Apparatus as claimed in claim 14 wherein the different rate is twice.

* * * * *